US005941731A

United States Patent [19]

Kodama

[11] Patent Number: 5,941,731

[45] Date of Patent: Aug. 24, 1999

[54] CONNECTOR HOLDING STRUCTURE

[75] Inventor: Shinji Kodama, Haibara-gun, Japan

[73] Assignee: Yazaki Corporation, Tokyo, Japan

[21] Appl. No.: 08/865,769

[22] Filed: May 30, 1997

[30] Foreign Application Priority Data

Jun. 3, 1996 [JP] Japan ..... 8-140016

[51] Int. Cl.[6] ..... H01R 13/73

[52] U.S. Cl. ..... 439/557; 439/553

[58] Field of Search ..... 439/246, 247, 439/248, 34, 557, 571, 567, 552, 544, 553, 310, 556, 555

[56] References Cited

U.S. PATENT DOCUMENTS 4,942,499 7/1990 Shibata et al. ..... 439/247
4,990,094 2/1991 Chandler et al. ..... 439/557

FOREIGN PATENT DOCUMENTS 2-12784 1/1990 Japan .
5-54934 3/1993 Japan .
5-61908 8/1993 Japan .

*Primary Examiner*—Paula Bradley
*Assistant Examiner*—Briggitte R. Hammond
*Attorney, Agent, or Firm*—Armstrong, Westerman, Hattori, McLeland & Naughton

[57] ABSTRACT

A first elastic arm with respect to a panel is provided in a movable connecting body having a connector. The movable connecting body is supported by the first elastic arm so that it is movable in a centripetal direction and by the second elastic element so that it is movable in a connector connecting direction. The second elastic element is provided on the panel or onto the movable connecting body. The panel is formed with a recess portion into which an electric wire from the connector is guided, and the second elastic element is provided within the recess portion and is constituted by an elastic spring element formed integrally by cutting and bending a section of the panel.

8 Claims, 4 Drawing Sheets

CONNECTOR HOLDING STRUCTURE

FIELD OF THE INVENTION

The present invention relates to a connector holding structure that supports a movable connecting body with a connector which is fitted to the instrument panel of a motor vehicle by an elastic body so that the connecting body is movable in a connector connecting direction.

DESCRIPTION OF THE RELATED ART

FIG. 6 shows the connector holding structure proposed in Japanese Patent Application Laid-Open No. HEI 8-22491 by the present applicant.

The connector holding structure is used for attaching a movable connecting body 32 to a part of the instrument panel 31 of a motor vehicle to attach a meter 33 to the instrument panel 31 and for connecting, at the same time, a stationary connecting body 34 on the side of a meter 33 to the movable connecting body 32.

The movable connecting body 32 consists of a movable frame 35 and a male connector 36 which is attached to the frame 35. The movable frame 35 has a first elastic arm 38 which is fitted into a panel hole 37, a second elastic arm 39 which abuts the surface of the instrument panel 31, an elastic support arm 40 which supports the male connector 36, and a nut 41.

The first elastic arm 38 supports the movable connecting body 32 so that the body 32 is movable in a horizontal direction (or in a centripetal direction). Also, the second elastic arm 39 urges the movable connecting body 32 to the side of the meter 33 and supports the movable connecting body 32 so that the connecting body 32 is movable in a connector connecting or disconnecting direction. In addition, the elastic support arm 40 supports the male connector 36 so that the connector 36 is movable vertically and horizontally (e.g., in a centripetal direction).

The aforementioned stationary connecting body 34 has a female connector 42 and a bolt 43. By screwing the bolt 43 into the nut 41, both connecting bodies 32 and 34 are connected together. When the connecting bodies 32 and 34 are connected together, the movable connecting body 32 is pulled to the side of the meter 33 and the first elastic arm 38 is detached from the panel 31 along with the second elastic arm 39. When, on the other hand, the movable connecting body 32 is disconnected from the stationary connecting body 34, the bolt 43 is inversely rotated and therefore the movable connecting body 32 reengages the panel 31. The second elastic arm 39 absorbs any error in the spacing L between the panel 31 and the meter 33 so that the connecting bodies 32 and 34 can be connected or disconnected reliably.

The aforementioned conventional structure, however, has the disadvantage that the movable connecting body 32 occupies a large space within the instrument panel even when the movable connecting body 32 is attached to the panel 31 as well as when the connecting bodies 32 and 34 are connected together, because the second elastic arm 39 protrudes in the longitudinal direction of the panel 1.

SUMMARY OF THE INVENTION

It is therefore an objective of the present invention to eliminate the aforementioned disadvantage and to provide a connector holding structure which renders it possible to save space within the instrument panel of a motor vehicle.

To achieve the above objective, in a connector holding structure, where a first elastic body for temporarily holding, with respect to a panel, is provided in a movable connecting body having a connector and where the movable connecting body is supported by the first elastic body so that it is movable in a centripetal direction and by the second elastic body so that it is movable in a connector connecting direction with respect to the panel, the second elastic body is provided in the panel.

Since the second elastic body is provided in the panel, the conventional second elastic body protruding in the longitudinal direction of the panel becomes unnecessary, and therefore, a reduction in the size of the movable connecting body is achieved. At the same time, not only when the movable connecting body is attached to the panel, but when the movable connecting body is moved in a connector connecting direction to connect the connector, the second elastic body does not move within the instrument panel as the conventional second elastic body does, and consequently, the saving of space within the instrument panel is achieved.

In a preferred form of the present invention, the panel is formed with a recess portion into which an electric wire from the connector is guided, and the second elastic body is provided within the recess portion.

Since the second elastic body is positioned within the wire guiding recess portion of the panel, the space within the instrument panel can be effectively utilized and the saving of space within the instrument panel is achieved.

In another preferred form of the present invention, the second elastic body is constituted by an elastic spring element formed integrally by cutting and bending a section of the panel.

Since the second elastic body is formed when the instrument panel is formed, there is no need to separately provide the second elastic body and therefore a reduction in the cost of the second elastic body is achievable.

In addition, in a connector holding structure, where a first elastic body and a second elastic body are provided in a direction perpendicular to a panel in a movable connecting body having a connector and where the movable connecting body is supported by the first elastic body so that it is movable in a centripetal direction and by the second elastic body so that it is movable in a connector connecting direction, the second elastic body is protruded and positioned within a recess portion formed in the panel for guiding an electric wire extending from the connector.

Because the second elastic body is positioned within the wire guiding recess portion of the panel, the space within the instrument panel can be effectively utilized and the saving of space within the instrument panel is achieved.

BRIEF DESCRIPTION OF THE DRAWINGS

The present invention will be described in further detail with reference to the accompanying drawings, in which.

DETAILED DESCRIPTION OF THE PREFERRED EMBODIMENTS

Referring to FIGS. 1 through 5, there is shown a preferred embodiment of a connector holding structure in accordance with the present invention.

The connector holding structure is characterized in that an elastic arm (e.g., first elastic body) 3 ($\mathbf{3}_1$ through $\mathbf{3}_3$) is provided on a movable frame 4 for supporting a movable connecting body 2 so that the connecting body 2 is movable in vertical and horizontal directions (e.g., in a centripetal direction) with respect to a plastic or metal panel 1 within an instrument panel 1' (FIG. 5) and also is characterized in that an elastic spring element (e.g., second elastic body) 6 is provided in the panel 1 for urging the movable connecting body 2 to the side of a forward meter (e.g., component) 5, that is, in a connector connecting direction.

Figure 2:
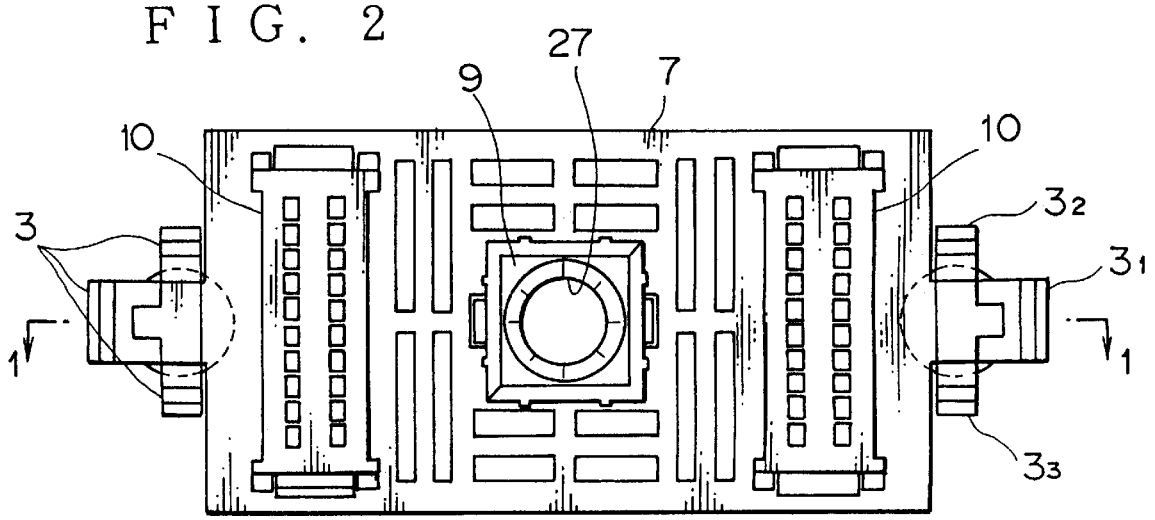
FIG. 2 is a front view showing the movable connecting body of the connector holding structure shown in FIG. 1.
Figure 3:
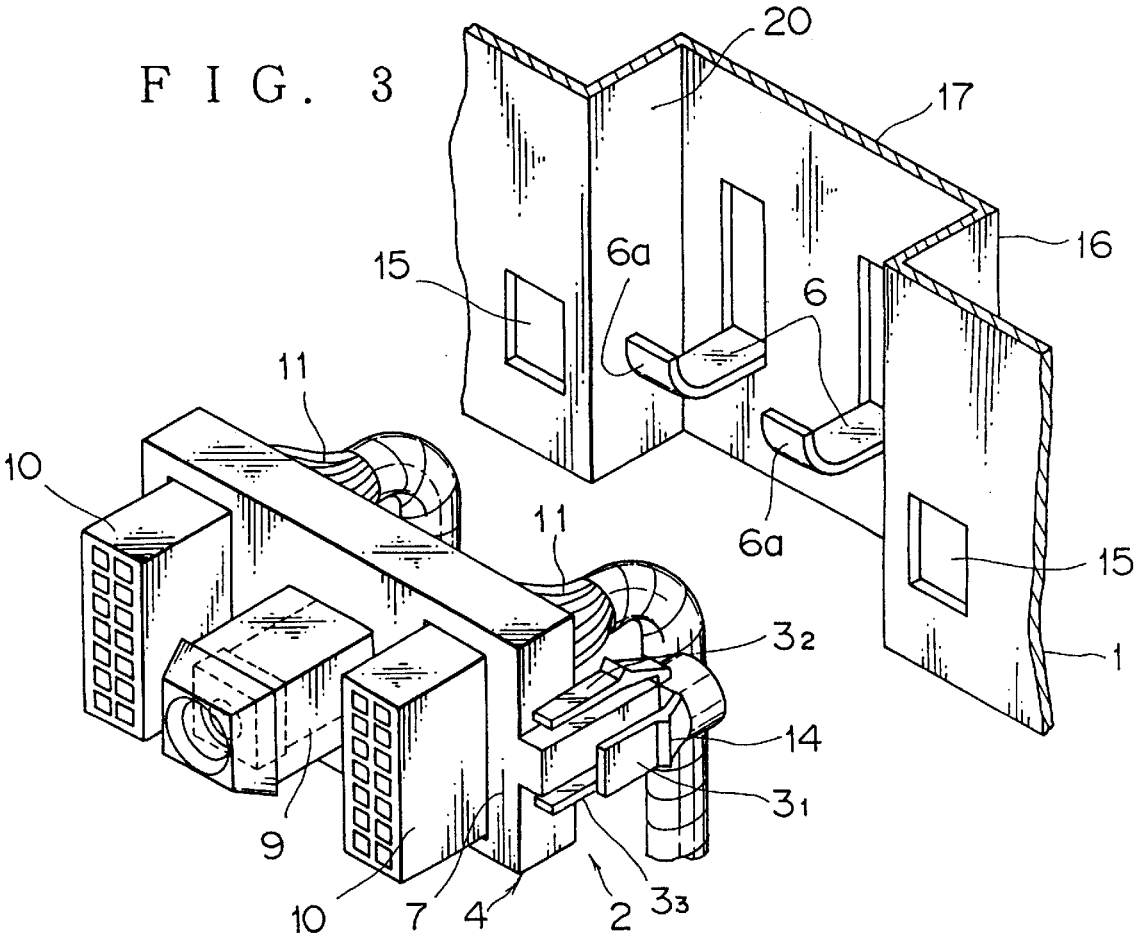
FIG. 3 is an exploded perspective view of the connector holding structure of FIG. 1 viewed from the front side.
Figure 4:
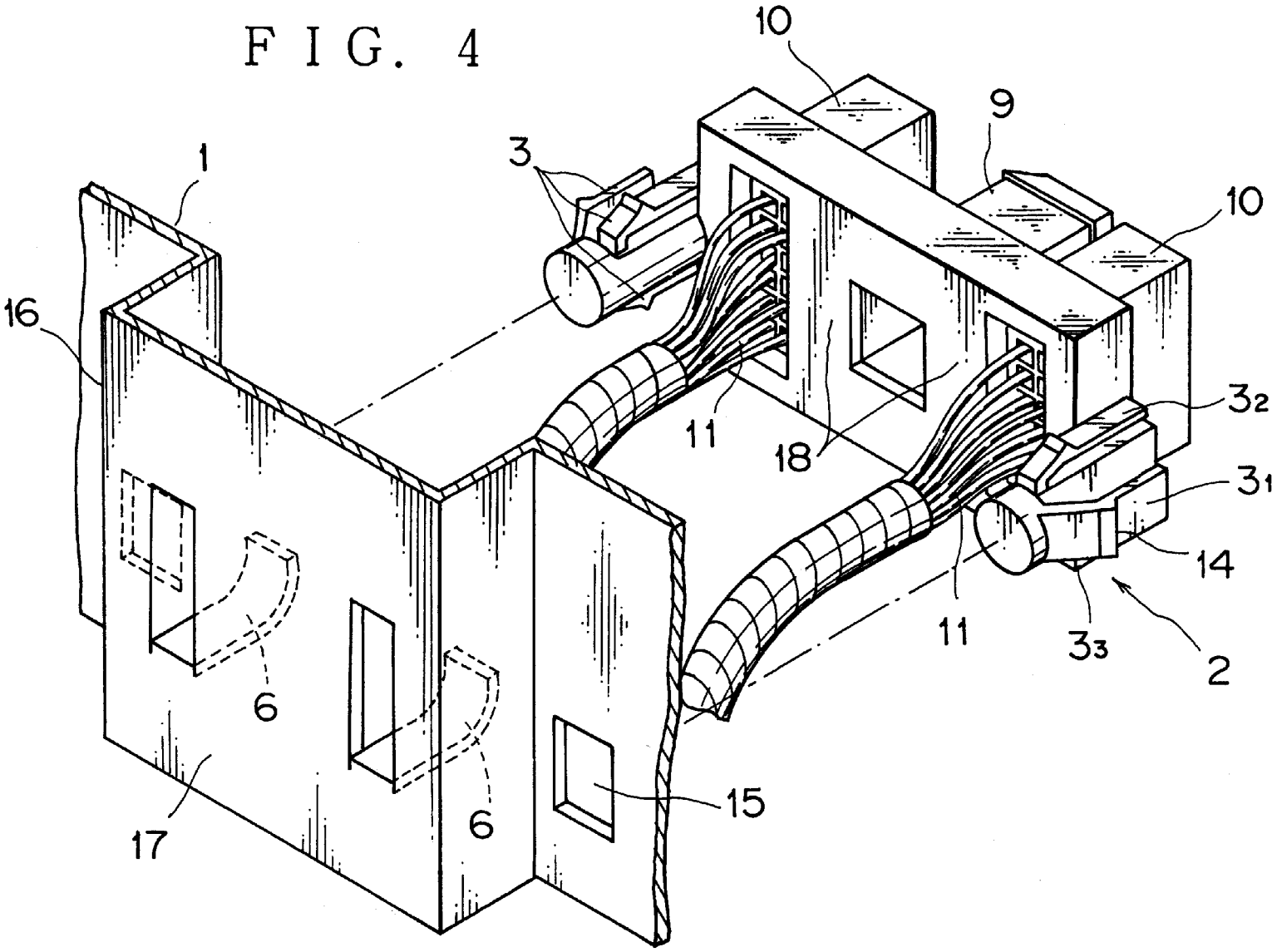
FIG. 4 is an exploded perspective view of the connector holding structure of FIG. 1 viewed from the rear side.

The movable frame 4 is equipped with a relatively thick base plate portion 7, support arms 8 protruding from the opposite ends of the base plate portion 7 to the side of the panel 1, the aforementioned elastic arms $\mathbf{3}_1$ through $\mathbf{3}_3$ trifurcated at the point end of each support arm 8 in three directions (up, down and left, or up, down and right) as shown in FIGS. 2 through 4, and a nut supporting sleeve 9 protruded toward the side of the meter 5 at the center of the base plate portion 7, and these are formed integrally in the movable frame 4 from synthetic resin. Thus, this embodiment renders the aforementioned conventional second elastic arm 39 shown in FIG. 6 unnecessary.

A pair of left and right male connectors 10 are mounted in the base plate portion 7 so that they are immovable toward the meter 5. At the back of the male connectors 10, the base plate portion 7 is formed with through holes 12 so that the electric wires (e.g., wire harnesses) 11 extending from the male connectors 10 can pass through the base plate portion 7. Note that the male connectors 10 can be formed integrally with the base plate portion 7 instead of forming them as separate members. A terminal 13 is accommodated within the male connector 10, and the electric wire harness 11 connected to the terminal 13 is guided to the side of the panel 1. The movable frame 4 and the male connectors 10 as a whole constitute the aforementioned movable connecting body 2.

Figure 6:
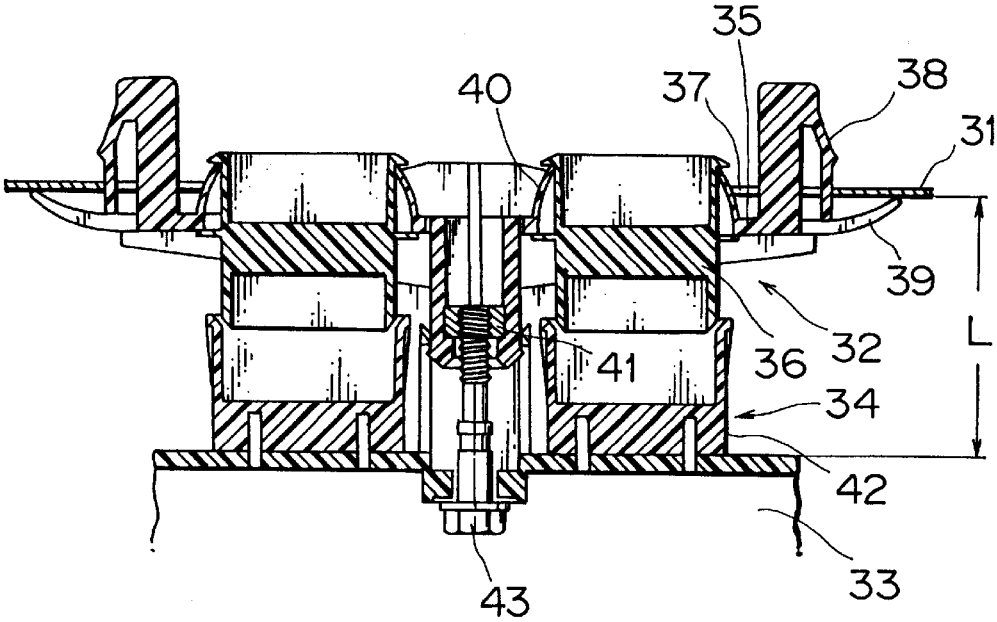
FIG. 6 PRIOR ART
FIG. 6 is a cross sectional view showing a conventional connector holding structure.

The elastic arm 3, as with the aforementioned conventional elastic arm 38 of FIG. 6, has a temporary anchor protrusion 14 at its intermediate portion and is temporarily engageable with the panel 1. The panel 1 is formed with a pair of left and right engagement holes 15 which are engaged by the left and right elastic arms 3 each consisting of three elastic arm portions $\mathbf{3}_1$ through $\mathbf{3}_3$. Also, between the pair of engagement holes 15, the panel 1 is formed with a recess portion 16 into which the electric wires 11 from the male connectors 10 are guided. Within the recess portion 16 the aforementioned pair of spaced elastic spring elements 6 are protruded and formed.

The pair of elastic spring elements 6 are formed by cutting and bending sections of the bottom wall 17 of the recess portion 16 of the panel 1, as shown in FIGS. 3 and 4. The elastic spring elements 6 are positioned between the electric wires 11 of a pair of male connectors 10, guided into the recess portion 16 of the panel 1, and the elements 6 elastically abut the rear flat abut surfaces 18 of the base plate portion 7 of the movable frame 4. The left abut surface 18 is formed between the left male connector 10 and the through hole 19 of the center nut support sleeve 9 in opposition to the left elastic spring element 6. Likewise, the right abut surface 18 is formed between the right male connector 10 and the through hole 19. The front ends 6*a* of the elastic spring elements 6 abut the abut surfaces 18, respectively. The electric wire 10 passes between the side wall 20 of the recess portion 16 and the elastic spring element 6 and is guided outside the panel 1.

Figure 5:
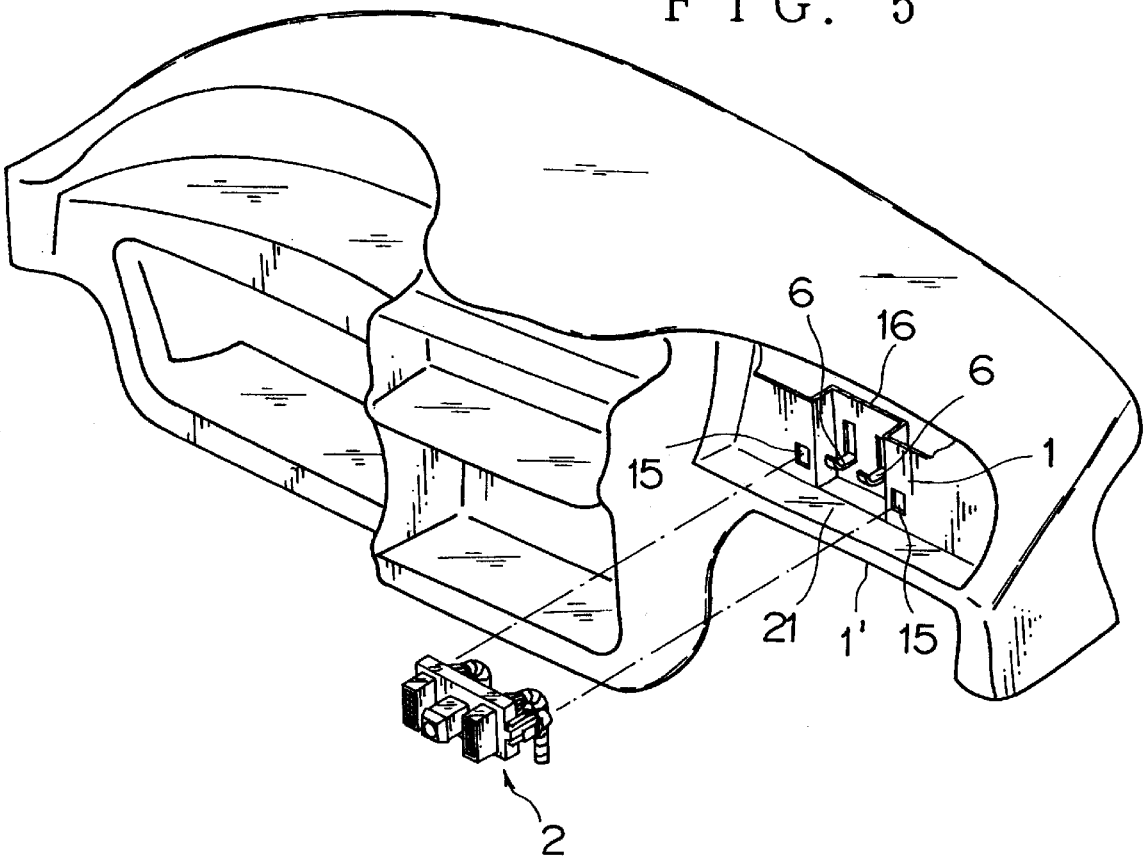
FIG. 5 is an exploded perspective view showing the position at which the movable connecting body is fitted to the instrument panel of a motor vehicle.

FIG. 5 shows the position at which the movable connecting body 2 is attached to the panel 1, and in this embodiment, the wire guiding recess portion 16 with the aforementioned elastic spring elements 6 is formed in the panel 1 of the meter attaching portion 21 of the instrument panel 1' of a motor vehicle.

Since the elastic spring elements 6, for supporting the movable connecting body 2 so that it is movable in the fore-and-aft direction, have been provided in the wire guiding recess portion 16 of the panel 1 within the instrument panel 1', the space within the instrument panel 1' can be effectively utilized. In addition, the conventional elastic arm (39 of FIG. 6) protruding in the longitudinal direction of the panel becomes unnecessary, and consequently, a reduction in the size of the connecting body 2 is achievable. Furthermore, since each of the left and right elastic arms 3 has been constituted by three arms portions protruded in three directions, the conventional connector support arm (40 of FIG. 6) becomes unnecessary, and consequently, a further reduction in the size of the movable connecting body 2 is achievable.

Figure 1:
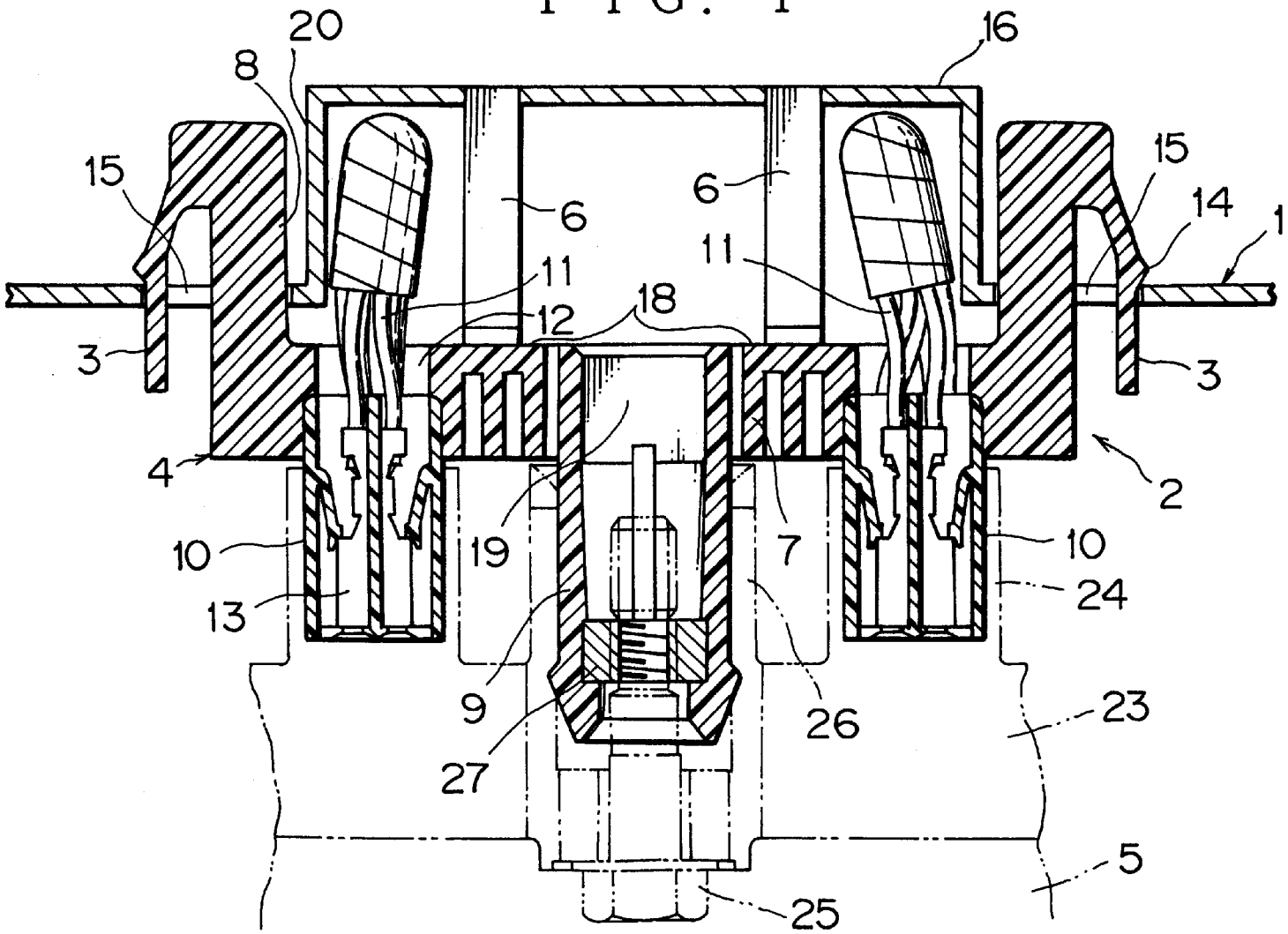
FIG. 1 is a cross sectional view of an embodiment of a connector holding structure of the present invention taken substantially along line A—A of FIG. 2.

In FIG. 1, reference numeral 23 denotes a stationary connecting body on the side of the meter 5. Reference numeral 24 denotes a female connector and 25 a bolt. Reference numeral 26 is a cylindrical wall formed integrally with the stationary connecting body 23, and 27 is a nut. In the completely engaged state of the bolt 25 and the nut 27, the movable connecting body 2 is completely fitted into the stationary connecting body 23, and although different from the figure, the movable connecting body 2 is positioned away from the panel 1, as in prior art.

When both connecting bodies 2 and 23 are connected together, the nut support sleeve 9 is first guided into the cylindrical wall 26. The positional offset at that time is absorbed by the trifurcated elastic arm 3 being bent in vertical and horizontal directions, and the initial connection is reliably performed. Also, the attachment of the movable connecting body 2 to the panel 1 is performed by inserting the left and right elastic arms 3 into the corresponding engagement holes 15 of the panel 1. The temporary anchor protrusion 14 of the elastic arm 3 passes through the engagement hole 15 and is positioned on the rear side of the panel 1. At this time, the movable connecting body 2 is brought into contact with the elastic spring elements 6 provided within the recess portion 16, and the movable connecting body 2 is prevented from being pushed too deeply. The movable connecting body 2 is pushed to the side of the meter 5 by the elastic spring elements 6, and in that state, the temporary anchor protrusions 14 of the elastic spring elements 6 abut the rear surface of the panel 1 and the movable connecting body 2 is temporarily held by the panel 1.

At the same time the meter 5 is attached to the instrument panel 1, the movable connecting body 2 is pushed by the stationary connecting body 23. The pushed movable connecting body 2 bends the elastic spring elements 6 and is moved rearward. At this time, the bent elastic spring elements 6 absorb any dimensional error between the meter 5 and the panel 1, so the spacing between the meter 5 and the panel 1 can be roughly set. In the state, by rotating and screwing the bolt 25 into the nut 27, the movable connecting body 2 is pulled to the side of the stationary connecting body 23, and both connecting bodies 2 and 23 are connected together.

As another embodiment of the aforementioned holding structure, a separate elastic body (not shown) may be provided in the panel 1. Also, the elastic spring elements (e.g., second elastic body) 6 may be protruded not from the recess portion 16 of the panel 1 but from the rear side of the base plate portion 7 of the movable connecting body 2, and the abut surfaces 18 may be formed on the recess portion 16. In this case, although the size of the connecting body 2 itself is increased by the elastic spring elements, the space of the recess portion 16 of the panel 1 is effectively utilized, and consequently, the saving of space within the instrument panel 1' is sufficiently achieved.

While the invention has been described with reference to preferred embodiments thereof, the invention is not to be limited to the details given herein, but may be modified within the scope of the appended claims.

What is claimed is:

1. In the attachment of a connector to a panel, a connector holding structure comprising:

an opening means in said panel, a movable connecting body having formed thereon first elastic member means received in said panel opening means, said first elastic member means being operative to elastically support said movable connecting body on said panel and to permit movement of said movable connecting body in a centripetal direction, and a second elastic member formed on said panel, said second elastic member engaging said movable connecting body and resilently biasing said movable connecting body in a direction opposing a direction of an application of a force for connecting said connector to said panel.

2. The connector holding structure as set forth in claim 1 in which said connector contains an electric wire extending therefrom, and wherein said panel, in a portion containing said second elastic member, is formed with a recess into which said electric wire from said connector is guided.

3. The connector holding structure as set forth in claim 1 or claim 2, wherein said second elastic member comprises an elastic spring element formed integrally with said panel by cutting and bending a section of said panel.

4. The connector holding structure as set forth in claim 3, wherein said first elastic member means each includes a support body extendable into said opening means in said panel, said support body having a leading end containing trifurcated elastic arms operative to engage a panel opening in three angularly spaced directions.

5. The connector holding structure as set forth in claim 4, wherein each of said elastic arms has a protrusion at its intermediate portion for temporarily holding said movable connecting body with respect to said panel.

6. A connector holding structure for the connection of a connector to a panel, said connector holding structure comprising a first elastic member and a second elastic member provided respectively in a direction perpendicular to said panel, said first elastic member being formed on a movable connecting body having a connector containing an electric wire extending therefrom, whereby said movable connecting body is supported by said first elastic member so that said movable connecting body is movable in a centripetal direction, and by said second elastic body so that said movable connecting body is resilently biased in a direction opposite a connector connecting direction, and said second elastic body is protruded from said panel and positioned within a recess portion formed in said panel for guiding said electric wire extending from said connector.

7. The connector holding structure as set forth in claim 6, wherein said first elastic member includes a support body having elastic trifurcated arms at a leading end of said support arm and engaging said panel in three angularly spaced directions.

8. The connector holding structure as set forth in claim 7, wherein each of said elastic arms has a protrusion at its intermediate portion for temporarily holding said movable connecting body with respect to said panel.

* * * * *